US011401667B2

(12) United States Patent
Stancescu

(10) Patent No.: US 11,401,667 B2
(45) Date of Patent: Aug. 2, 2022

(54) MODULAR ORTHOTROPIC STEEL BRIDGE DECK

(71) Applicant: Daniel Stancescu, Toronto (CA)

(72) Inventor: Daniel Stancescu, Toronto (CA)

( * ) Notice: Subject to any disclaimer, the term of this patent is extended or adjusted under 35 U.S.C. 154(b) by 156 days.

(21) Appl. No.: 16/991,155

(22) Filed: Aug. 12, 2020

(65) Prior Publication Data

US 2022/0049438 A1 Feb. 17, 2022

(51) Int. Cl.

| | |
|---|---|
| ***E01C 19/12*** | (2006.01) |
| ***E01D 19/12*** | (2006.01) |
| *E01D 101/30* | (2006.01) |
| *E01D 101/26* | (2006.01) |

(52) U.S. Cl.

CPC ..... *E01D 19/125* (2013.01); *E01D 2101/26* (2013.01); *E01D 2101/30* (2013.01)

(58) Field of Classification Search

CPC ..... E01D 19/125; E01D 2101/26; E01D 2101/30

USPC ..... 14/73–77.1

See application file for complete search history.

(56) References Cited

U.S. PATENT DOCUMENTS

| | | | | |
|---|---|---|---|---|
| 3,302,361 | A * | 2/1967 | Oudheusden, Jr. | E01D 19/125 52/798.1 |
| 4,129,917 | A * | 12/1978 | Sivachenko | E01D 11/02 52/843 |
| 5,966,764 | A * | 10/1999 | Vodicka | E01D 19/02 14/77.1 |
| 6,286,352 | B1 * | 9/2001 | Hackstock | B21D 5/08 72/167 |
| 7,069,614 | B1 * | 7/2006 | Sivachenko | E01D 2/00 52/579 |
| 8,925,132 | B1 * | 1/2015 | Quinonez | E01D 2/02 14/77.1 |
| 9,915,045 | B1 * | 3/2018 | Azizinamini | E01D 2/00 |
| 10,718,094 | B1 * | 7/2020 | Nelson | E04C 3/294 |
| 2009/0077758 | A1 * | 3/2009 | Vincent | E01D 22/00 14/73 |
| 2015/0251234 | A1 * | 9/2015 | Daimaru | B21D 5/083 72/181 |
| 2018/0135261 | A1 * | 5/2018 | Nelson | E01D 2/02 |

FOREIGN PATENT DOCUMENTS

| | | | | |
|---|---|---|---|---|
| GB | 1562688 | * | 3/1980 | E04B 1/24 |

* cited by examiner

*Primary Examiner* — Raymond W Addie

(57) ABSTRACT

A new modular orthotropic steel bridge deck, and its manufacturing method, which introduces the design standardization of the orthotropic steel bridge deck designs, thereby, leading to cost-effective solutions by avoiding the complexities and costly details that are unnecessary for orthotropic steel bridge deck and short span bridge applications.

18 Claims, 1 Drawing Sheet

MODULAR ORTHOTROPIC STEEL BRIDGE DECK

FIELD OF THE DISCLOSURE

The present disclosure relates to modular orthotropic steel bridge decks, to be used in building bridges.

BACKGROUND OF THE INVENTION

Presently, the prevailing use for orthotropic steel bridge deck designs is on high traffic volume, long span bridges (e.g., more than 140 feet) with a focus on deadload weight reduction. The weight savings require customized designs, due to complex geometries and details needed to ensure robust fatigue performance. Also, the weight savings require an increase in fabrication cost, due to tight tolerances and detailed welding specifications.

However, the low traffic volume, short span bridges (e.g., less than 140 feet) are not subject to the high fatigue demands found on the long span bridges. As an example, the Average Daily Traffic (ADT) for short span bridges is 7,533 compared to 22,245 for long span bridges. As a result of the reduced overall fatigue demands, the short span bridges do not require complex geometries and hence, customized designs. Also, as a result of the reduced overall fatigue demands, the short span bridges do not require tight tolerances and hence, increased fabrication costs.

Moreover, currently, there is a void of catalogues for designers and off-the-shelf products for owners and contractors. Majority of the orthotropic steel bridge deck designs are customized making the decision process difficult and it does not give owners, designers and contractors confidence in the chosen design and the cost of the final product.

BRIEF SUMMARY OF THE INVENTION

The present invention advances bridge construction by introducing modular orthotropic steel bridge decks which avoid design complexities and costly details that are unnecessary for orthotropic steel bridge deck and short span bridge applications. The inclusion of a concrete deck layer is a notable difference between the present invention and the existing orthotropic steel bridge deck designs. The concrete deck layer simplifies fabrication details, thereby increasing the system's economics and feasibility in the short span bridge market.

Moreover, the present invention permits the development of modular designs allowing further standardization for bridges, thereby leading to greater certainty in costs to owners, designers and contractors. This, in turn, provides opportunity to achieve cost savings through economy of scale. The standardized designs may be characterized by predetermined calculations and performance evaluations to make the decision process easier and to give owners, designers and contractors confidence in the chosen design.

The low traffic volume, short span bridge market is defined by cost sensitivity, minimization of structure depth, ease of construction and speed. The present invention is the first steel alternative to meet and exceed existing structure types in these four areas. This new design is unique and it would focus on the low traffic volume, short span bridge applications where the standardization and economical design of the orthotropic steel bridge deck would be very advantageous.

BRIEF DESCRIPTION OF THE SEVERAL VIEWS OF THE DRAWINGS

The nature and mode of operation of the present invention will now be more fully described in the following detailed description taken with the accompanying drawing figures, in which.

DETAILED DESCRIPTION OF THE INVENTION

Figure 1:
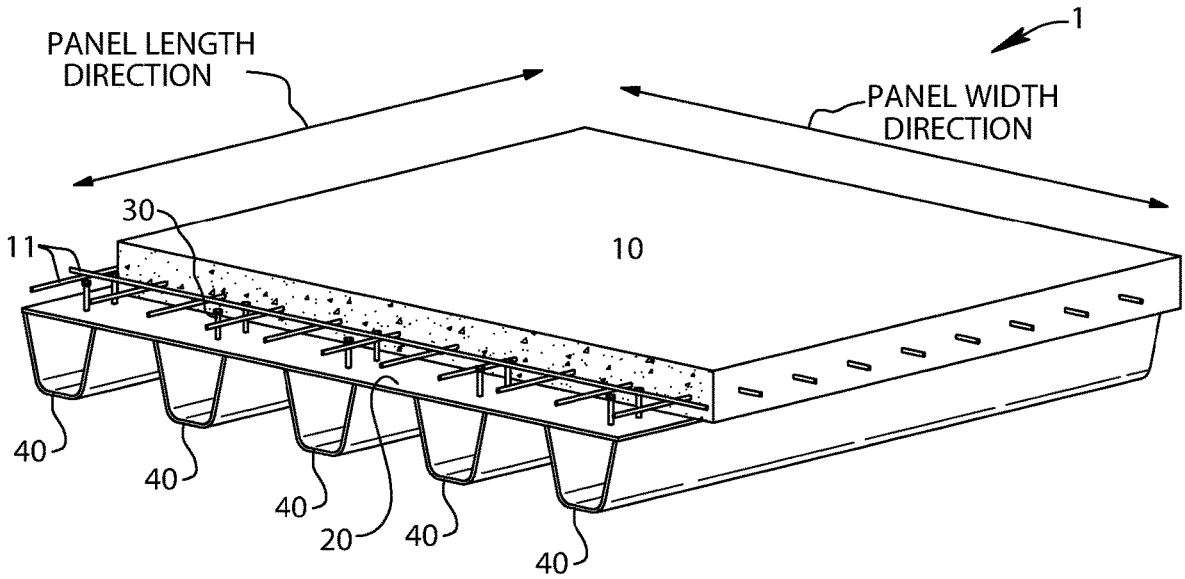
FIG. 1 is a perspective view of a modular orthotropic steel bridge deck manufactured in accordance with an embodiment of the present invention.
Figure 2:
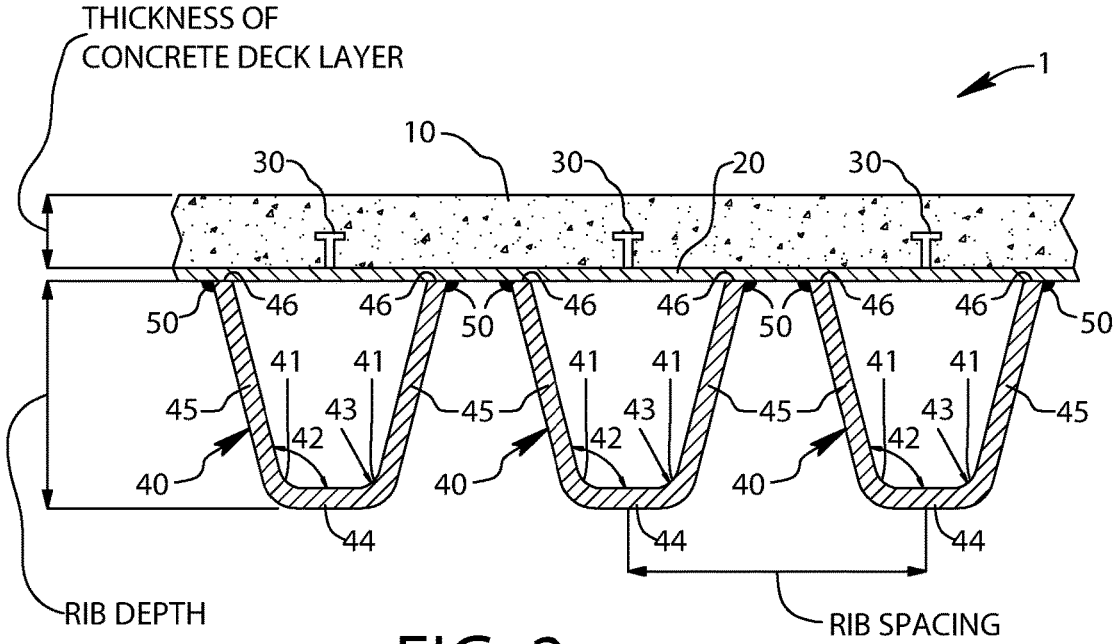
FIG. 2 is a partial cross-sectional view thereof.

FIGS. 1 and 2 show a modular orthotropic steel bridge deck 1 manufactured in accordance with an embodiment of the present invention.

Modular orthotropic steel bridge deck 1 generally comprises a concrete deck layer 10 sitting on a flat steel deck plate 20, a series of shear studs 30 and a series of trapezoidal steel ribs 40 longitudinally welded to the flat steel deck plate 20.

Modular orthotropic steel bridge deck 1 is aimed to be used for short single span bridges with a typical width of 33 feet. This will accommodate two traffic lanes each with a width of 11 feet.

Concrete deck layer 10 may be joined to flat steel deck plate 20 by a series of shear studs 30 and may include rebar reinforcement 11. The thickness of concrete deck layer 10 may be the thickness required for mitigating fatigue cracking of the welds between flat steel deck plate 20 and trapezoidal steel ribs 40. Determination of a suitable thickness for concrete deck layer 10 may be done by finite element analysis (FEA) modeling.

Concrete deck layer 10 may be poured and cured in whole or in part at one or more manufacturing facilities remote from the bridge construction site, and then shipped to the construction site for completion (if necessary) and installation. The advantage is the greater control over the entire manufacturing process and avoiding weather conditions.

In some situations, concrete deck layer 10 may be poured and cured at the construction site for completion. The advantage is the reduced shipping costs.

As a non-limiting example, ASTM A709 Grade 50 or Grade 50W (W stands for weathering) steel plate material may be used for the flat steel deck plate 20. Other steel grades, including stainless steel, may be used. By way of further non-limiting example, ASTM A709 Grade 50CR (ASTM A1010) stainless steel, such as DURACORR® Grade 50 from ArcelorMittal USA, may be used for the flat steel deck plate 20.

Alternatively, when weathering steel plate material is not an option, flat steel deck plate 20 may be galvanized for corrosion protection against moisture. In the galvanizing process, iron from the steel has a metallurgical reaction with molten zinc to form a coating that protects the steel from corrosion in severe environments and provides maintenance-free longevity; e.g. between 34 and 70 years.

The illustrated flat steel deck plate 20 may be 120-inch wide, ½-inch thick and may have any suitable length. Due to shipping limitations, any length up to 110 feet is commercially viable. Other dimensions may be used for the flat steel deck plate 20 to suit the needs of the bridge design.

The series of shear studs 30 installed on the flat steel deck plate 20 are used for achieving composite action with the concrete deck layer 10.

Each trapezoidal steel rib 40 includes a pair of internal longitudinal equal bends 41 with the same angle 42 and bending radius 43, a bottom wall 44, a pair of side walls 45 and a terminating edge 46.

The spacing and depth of the trapezoidal steel ribs 40 are function of achieving the bridge maximum span.

The bending angle 42 and bending radius 43 are subject to variation to meet design criteria and must adhere to AASHTO standard. Presently, the AASHTO standard requires a bending radius equal to five times the steel plate material thickness.

Bends 41 could be formed by passing steel plate material through three different types of equipment and process; cold roll forming, brake press cold forming and hot roll forming.

The steel plate material for trapezoidal steel ribs 40 may be a desired thickness and width for achieving the desired dimensions (e.g., bending angle 42, bending radius 43, bottom wall 44, side walls 45) and desired depth. The steel plate material may be cut to a desired length before or after the trapezoidal steel ribs 40 are formed.

As a non-limiting example, ASTM A709 Grade 50 or Grade 50W (W stands for weathering) steel plate material may be formed to produce trapezoidal steel ribs 40. Other steel grades, including stainless steel, may be used to form trapezoidal steel ribs 40. By way of further non-limiting example, ASTM A709 Grade 50CR (ASTM A1010) stainless steel, such as DURACORR® Grade 50 from ArcelorMittal USA, may be used to form trapezoidal steel ribs 40.

Alternatively, when weathering steel plate material is not an option, trapezoidal steel ribs 40 may be galvanized for corrosion protection against moisture. In the galvanizing process, iron from the steel has a metallurgical reaction with molten zinc to form a coating that protects the steel from corrosion in severe environments and provides maintenance-free longevity; e.g. between 34 and 70 years.

Trapezoidal steel ribs 40 may be joined to an underside surface of flat steel deck plate 20 by longitudinal welds 50 provided along each terminating edge 46 and the underside surface of flat steel deck plate 20. Terminating edges 46 may be beveled by grinding. In some situations, the natural bevel from forming process may be used.

The welding joint may be a longitudinal fillet weld with reinforcement to compensate for small gap penetrations.

In some situations, the welding joint may be a longitudinal groove weld with, as a non-limiting example, 50% Partial Joint Penetration.

While the invention has been described in connection with exemplary embodiments, the detailed description is not intended to limit the scope of the disclosure to the particular forms set forth. The invention is intended to cover such alternatives, modifications and equivalents of the described embodiments as may be apparent to one of ordinary skill in the art.

What is claimed is:

1. A method of manufacturing a modular orthotropic steel bridge deck comprising the steps of:

attaching a series of trapezoidal steel ribs to the bottom surface of a flat steel deck plate by a series of longitudinal welds provided along terminating edges and the underside surface of the flat steel deck plate, spacing the series of trapezoidal steel ribs to achieve a maximum span of the modular orthotropic steel bridge deck, the series of longitudinal welds can be either a fillet weld or a groove weld, passing an unheated steel plate material through a cold roll forming equipment having a plurality of stations to progressively form the series of trapezoidal steel ribs, continue passing the series of trapezoidal steel ribs through a final specially configured subset of the plurality of cold roll forming stations to progressively induce a positive camber in the series of trapezoidal steel ribs, the final specialized configured subset to include a station to provide a fixed-roller anchor point, followed by one or more vertically actuated rollers automatically moving up and down to engage the passing of the series of trapezoidal steel ribs, and a final station may be set up to provide another fixed-roller anchor point, pouring and curing a concrete deck layer on the top surface of the flat steel deck plate for mitigating fatigue cracking of the series of longitudinal welds between the flat steel deck plate and the series of trapezoidal steel ribs, the concrete deck layer may include a rebar reinforcement to provide tensile strength and to make the concrete deck layer more resistant under tension, the concrete deck layer may be poured and cured in whole or in part at one or more manufacturing facilities remote from a construction site, and then shipped to the construction site for completion, the concrete deck layer may be poured and cured at the construction site for completion.

2. The method according to claim 1, further comprising connecting a series of shear studs on the top surface of the flat steel deck plate for achieving composite action with the concrete deck layer.

3. The method according to claim 1, wherein the positive camber is approximately ½ inch per 10 feet of length.

4. The method according to claim 1, further comprising the series of trapezoidal steel ribs having a pair of internal longitudinal equal bends with a bending radius in accordance with AASHTO standards.

5. The method according to claim 4, further comprising the series of trapezoidal steel ribs progressively manufactured using the cold roll forming equipment.

6. The method according to claim 1, further comprising cutting the unheated steel plate material to desired length.

7. The method according to claim 4, further comprising the series of trapezoidal steel ribs suddenly manufactured using a brake press cold forming equipment.

8. The method according to claim 7, further comprising configuring the brake press cold forming equipment to suddenly clamp the unheated steel plate material between a matching punch and a die to form the pair of internal longitudinal equal bends.

9. The method according to claim 8, further comprising cutting the unheated steel plate material to desired length.

10. The method according to claim 4, further comprising the series of trapezoidal steel ribs progressively manufactured using a hot roll forming equipment.

11. The method according to claim 10, further comprising:

passing a heated steel plate material through the hot roll forming equipment having a plurality of stations to progressively form the series of trapezoidal steel ribs, continue passing the series of trapezoidal steel ribs through a final specially configured subset of the plurality of hot roll forming stations to progressively induce the positive camber in the series of trapezoidal steel ribs.

12. The method according to claim 11, further comprising cutting the heated steel plate material to desired length.

13. A trapezoidal steel rib with the pair of internal longitudinal equal bends, with the bending radius in accordance with AASHTO standards, made according to the method of claim 1.

14. The trapezoidal steel rib according to claim 13, further comprising:

the length of the unheated steel plate material progressively cold roll formed by passage through the plurality of stations of the cold roll forming equipment to include the pair of internal longitudinal equal bends, the positive camber progressively induced by the final specially configured subset of the plurality of cold roll forming stations, the final specialized configured subset to include the station to provide the fixed-roller anchor point, followed by one or more vertically actuated rollers automatically moving up and down to engage the passing of the trapezoidal steel ribs, and the final station may be set up to provide another fixed-roller anchor point.

15. The trapezoidal steel rib according to claim 14, wherein the positive camber is approximately ½ inch per 10 feet of length.

16. The trapezoidal steel rib according to claim 13, wherein the length of the unheated steel plate material is suddenly cold formed by clamping through the brake press cold forming equipment to include the pair of internal longitudinal equal bends.

17. The trapezoidal steel rib according to claim 13, further comprising:

the length of the heated steel plate material progressively hot roll formed by passage through the plurality of stations of the hot roll forming equipment to include the pair of internal longitudinal equal bends, the positive camber progressively induced by the final specially configured subset of the plurality of hot roll forming stations.

18. The trapezoidal steel rib according to claim 13, wherein the terminating edges may be beveled either during the forming process or through separate grinding operation.

* * * * *